US007014285B2

(12) United States Patent
Tanno

(10) Patent No.: US 7,014,285 B2
(45) Date of Patent: Mar. 21, 2006

(54) INK JET PRINTER

(75) Inventor: Ryuji Tanno, Hachioji (JP)

(73) Assignee: Konien Minolta Holdings, Inc., (JP)

( * ) Notice: Subject to any disclaimer, the term of this patent is extended or adjusted under 35 U.S.C. 154(b) by 214 days.

(21) Appl. No.: 10/761,630

(22) Filed: Jan. 20, 2004

(65) Prior Publication Data

US 2004/0150681 A1 Aug. 5, 2004

(30) Foreign Application Priority Data

Jan. 28, 2003 (JP) ..... 2003-018721
Jan. 28, 2003 (JP) ..... 2003-018728
Dec. 10, 2003 (JP) ..... 2003-411566

(51) Int. Cl.
*B41J 29/38* (2006.01)

(52) U.S. Cl. ..... 347/6; 347/85; 347/23

(58) Field of Classification Search ..... 347/6
See application file for complete search history.

(56) References Cited

U.S. PATENT DOCUMENTS 6,315,402 B1 * 11/2001 Kawase ..... 347/85
2004/0113971 A1 * 6/2004 Nakajima ..... 347/29

FOREIGN PATENT DOCUMENTS

JP 2980476 11/1993

* cited by examiner

*Primary Examiner*—David M. Gray
*Assistant Examiner*—Brian J. Goldberg
(74) *Attorney, Agent, or Firm*—Cantor Colburn LLP

(57) ABSTRACT

An ink jet printer includes a recording head having nozzles for jetting ink onto a recording medium, an intermediate tank for temporarily storing ink in a lower position of the recording head, and an ink supply line for feeding the ink between the intermediate tank and the recording head, wherein when a viscosity of the ink is $\mu$ and pressure loss which allows the ink to be stably jetted is h, a length L and a diameter d of the ink supply line satisfy an inequality: $(2.823\times10^9\times d^4)/L>\mu/h$.

15 Claims, 5 Drawing Sheets

INK JET PRINTER

BACKGROUND OF THE INVENTION

1. Field of the Invention

The present invention relates to an ink jet printer. In particular, the present invention relates to an ink jet printer for forming an image by using high viscosity ink.

2. Description of Related Art

According to an earlier development, an ink jet printer has a recording head having nozzles for jetting ink onto a recording medium. The conventional ink jet printer has an ink supply section for supplying ink in an upper position of the recording head, and an intermediate tank for temporarily storing ink supplied from the ink supply section in a lower position of the recording head. Ink is fed from the intermediate tank to the recording head through an ink supply line. In this ink jet printer, because the intermediate tank is disposed in a lower position of the recording head, negative pressure is applied to ink of the nozzles.

In the ink jet printer according to an earlier development, regardless of the viscosity of the ink to be used and the amount of ink to be jetted per second, a length and a diameter of the ink supply line are defined only by the request of mechanism. However, in case high viscosity ink is used, friction resistance of the ink supply line causes pressure loss. Thereby, for example, in case ink is continuously jetted from all of the nozzles, the proper amount of ink is not supplied to the recording head, which may result in abnormal jetting of ink. For that, there is an ink jet printer having a pressure supply system of ink for pushing ink to the recording head (Japanese patent No.2980476).

However, in an ink jet printer according to an earlier development, because a pressure supply system was disposed, there was a problem that design was complicated and the cost thereof was high.

SUMMARY OF THE INVENTION

An object of the present invention is to provide an ink jet printer, in which high viscosity ink can be supplied from an intermediate tank to a recording head by simple design under a stable condition and a good image can be recorded.

In order to solve the above problem, in accordance with a first aspect of the invention, an ink jet printer comprises a recording head having nozzles for jetting ink onto a recording medium, an intermediate tank for temporarily storing ink in a lower position of the recording head, and an ink supply line for feeding the ink between the intermediate tank and the recording head, wherein when a viscosity of the ink is $\mu$ and pressure loss which allows the ink to be stably jetted is h, a length L and a diameter d of the ink supply line satisfy an inequality: $(2.823\times10^9\times d^4)/L>\mu/h$.

It is preferable that the ink has the viscosity of not less than 10 mPa·s and not more than 500 mPa·s at a temperature of 30° C., the recording head comprises a heater for heating ink and a control section for controlling a temperature of the heater; and the control section controls the heater to heat the ink to a temperature of not less than 30° C. and not more than 150° C.

It is preferable that the ink is ultraviolet curable ink, and the ink jet printer further comprises an ultraviolet irradiating device for irradiating ultraviolet rays for curing the ultraviolet curable ink.

It is preferable that the ultraviolet curable ink is cationic polymerized ink.

In accordance with a second aspect of the invention, an ink jet printer comprises a recording head having nozzles for jetting ink onto a recording medium, an intermediate tank for temporarily storing ink in a lower position of the recording head, and an ink supply line for feeding the ink between the intermediate tank and the recording head, wherein when a viscosity of the ink is $\mu$, a length L and a diameter d of the ink supply line satisfy an inequality: $(1.411\times10^9\times d^4)/L>\mu$.

According to this ink jet printer, in relation to a viscosity $\mu$ of the ink, because the length L and the diameter d of the ink supply line are configured, under the flow velocity of ink flowing through the constant ink supply line, pressure loss can be restrained when ink is fed through the ink supply line and then the proper amount of ink is always supplied to the recording head.

Thereby, even if the pressure supply system is not disposed, the proper amount of ink is always supplied to the recording head. As a result, even if ink is continuously jetted from all of the nozzles, a good image can be recorded by a simple design without abnormal jetting of ink.

It is preferable that a viscosity of the ink is not less than 10 mPa·s and not more than 500 mPa·s at a temperature of 30° C., and the recording head comprises a heater for heating ink and a control section for controlling a temperature of the heater and the control section controls the heater to heat the ink to a temperature of not less than 30° C. and not more than 150° C.

According to this ink jet printer, because ink is heated to a temperature of not less than 30° C. and not more than 150° C., a high viscosity ink is smoothly jetted from the recording head at the predetermined velocity. Thereby, the proper amount of ink is always supplied to the recording head.

Thereby, a good image can be recorded by a simple design without abnormal jetting of ink.

Further, it is preferable that the ink is ultraviolet curable ink and an ultraviolet irradiating device for irradiating ultraviolet rays for curing the ultraviolet curable ink is disposed.

According to this ink jet printer, the proper amount of ultraviolet curable ink is always supplied to the recording head and then jetted from the recording head. The jetted ultraviolet curable ink is cured by ultraviolet irradiation.

Thereby, a good image can be recorded by a simple design without abnormal jetting of ink.

It is preferable that the ultraviolet curable ink is cationic polymerized ink.

According to this ink jet printer, the proper amount of cationic polymerized ink is always supplied to the recording head and then jetted from the recording head. Because cationic polymerized ink is not affected by oxygen, cationic polymerized ink is preferably cured by low intensity of ultraviolet rays.

Thereby, a good image can be recorded by a simple design at a lower cost without abnormal jetting of ink.

In accordance with a third aspect of the invention, an ink jet printer comprising, a recording head having nozzles for jetting ink onto a recording medium, an intermediate tank for temporarily storing ink in a lower position of the recording head, and an ink supply line for feeding the ink between the intermediate tank and the recording head, wherein when a predetermined amount of ink having a predetermined viscosity is jetted from the recording head, a flow velocity of ink in the ink supply line is V, a length L and a diameter d of the ink supply line satisfy an inequality: $(2500\times d^2)/L>V$.

According to this ink jet printer, in relation to the flow velocity of ink V which is caused by jetting the predetermined amount of predetermined viscosity ink jetted from the recording head, because the length L and the diameter d of the ink supply line are configured, pressure loss can be restrained when ink is fed through the ink supply line and then the proper amount of ink is always supplied to the recording head.

Thereby, even if the pressure supply system is not disposed, and even if ink is continuously jetted from all of the nozzles, a good image can be recorded by a simple design without abnormal jetting of ink.

Further, it is preferable that the recording head comprises a heater for heating ink and a control section for controlling a temperature of the heater and the control section controls the heater to heat the ink to a temperature of not less than 30° C. and not more than 150° C.

According to this ink jet printer, because ink is heated to a temperature of not less than 30° C. and not more than 150° C., ink is smoothly jetted from the recording head at the predetermined viscosity. Thereby, the proper amount of ink is always supplied to the recording head.

Thereby, a good image can be recorded by a simple design without abnormal jetting of ink.

Further, it is preferable that the ink is ultraviolet curable ink and an ultraviolet irradiating devices for irradiating ultraviolet rays for curing the ultraviolet curable ink is disposed.

According to this ink jet printer, the proper amount of ultraviolet curable ink is always supplied to the recording head and then jetted from the recording head. The jetted ultraviolet curable ink is cured by ultraviolet irradiation.

Thereby, a good image can be recorded by a simple design without abnormal jetting of ink.

Further, it is preferable that the ultraviolet curable ink is cationic polymerized ink.

According to this ink jet printer, the proper amount of cationic polymerized ink is always supplied to the recording head and then jetted from the recording head. Because cationic polymerized ink is not affected by oxygen, cationic polymerized ink is preferably cured by low intensity of ultraviolet rays.

Thereby, a good image can be recorded by a simple design without abnormal jetting of ink.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

DETAILED DESCRIPTION OF THE PREFERRED EMBODIMENT

First Embodiment:

Hereinafter, the embodiment of the present invention will be described with reference to FIGS. 1 to 4.

Figure 1:
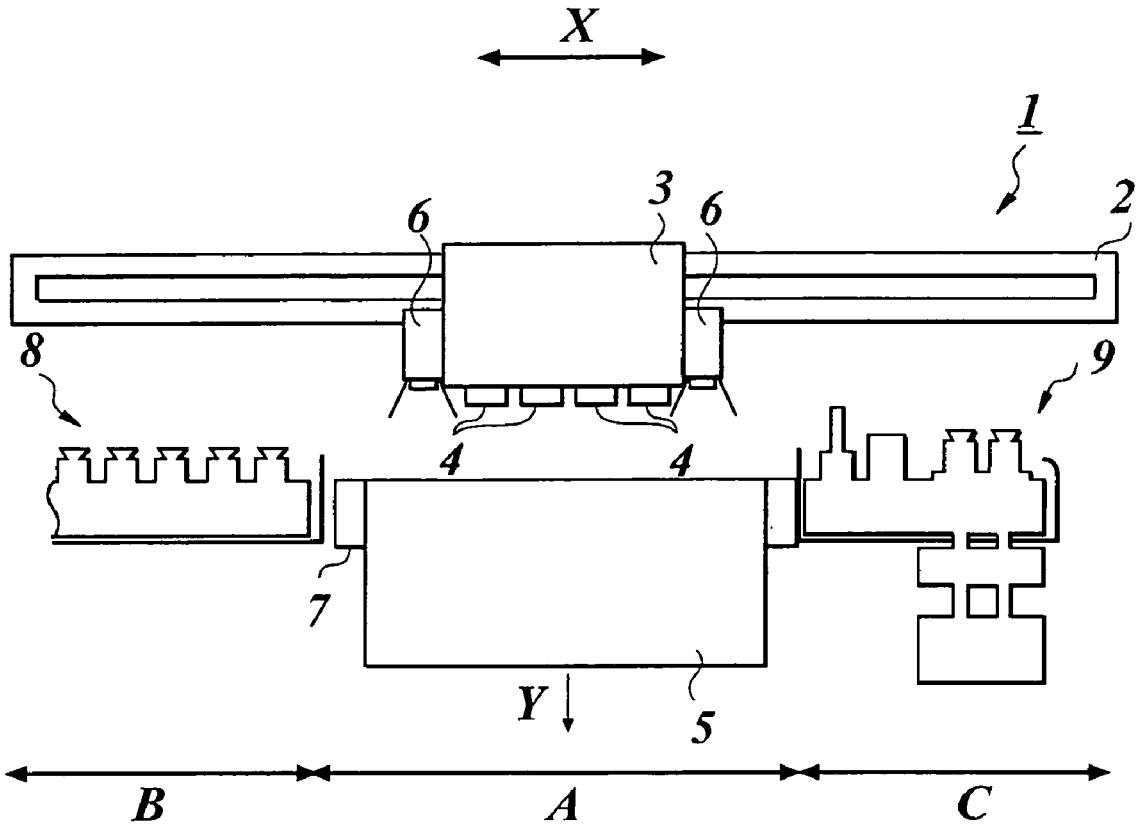
FIG. 1 is a view showing a structure of one of the embodiments of the ink jet printer of the invention.

The ink jet printer 1 of the embodiment is a serial-head type of ink jet printer 1. The ink jet printer 1, as shown in FIG. 1, has a rod-shaped guide rail 2. A carriage 3 is supported by the guide rail 2. A driving mechanism (not illustrated) allows the carriage 3 to reciprocate along the guide rail 2 in the main scanning direction X.

The carriage 3 comprises a recording head 4 having nozzles 20 (referred to FIG. 2) for jetting each color ink of yellow (Y), magenta (M), cyan (C) and black (K). Further, an ultraviolet irradiating device 6 for irradiating ultraviolet rays to ink jetted from the nozzles 20 onto the recording medium 5 are disposed at the both ends of the carriage 3 along the main scanning-direction X.

Further, ink used in the embodiment is ultraviolet curable ink that is cured by ultraviolet irradiation. Although ultraviolet curable ink is, as polymerized compound, categorized broadly into radical-polymerized type of ink including radical polymerized compound and cationic-polymerized type of ink including cationic polymerized compound, both types of ink are applicable to the embodiment. Hybrid type of ink mixed with radical polymerized ink and cationic polymerized ink may also be applied as ink of the embodiment. However, because cationic polymerized ink that is little or not affected by oxygen in the polymerization reaction has greater functionality and versatility than any other ink, in particular, it is preferable that cationic polymerized ink is used. Further, it is preferable that ink viscosity is between 10 mPa·s and 500 mpa·s at a temperature of 30° C.

A middle portion of the movable area for the carriage 3 is a recording region A in which an image or the like is recorded on the recording medium 5. Platens 7 for supporting the recording medium 5 from non-recording sides are disposed in the recording region A. The platen 7 is made of plate-shaped member. One outside region of the recording region A, which is in a movable area of the carriage 3, is a home position region B for a standby position of the carriage 3. A moisture retaining unit 8 for preventing ink of the nozzles 20 from drying during standby time is disposed in the home position region B. Further, the other outside region of the recording region A, which is in the movable area of the carriage 3, is a cleaning region C in which the recording head 4 is cleaned. A maintenance unit 9 for absorbing ink of the nozzles 20 and for wiping off ink adhered to the surface on which the nozzles 20 of the recording head 4 are formed, is disposed in the cleaning region C.

Further, transport mechanism (not illustrated) for transporting the recording medium 5 in a sub scanning direction Y that is orthogonal to the main scanning direction X, is disposed in the ink jet printer 1. Transport mechanism follows the motion of the carriage 3, and repeats transport and stop of the recording medium 5 to intermittently transport the recording medium 5 during image recording time.

Figure 2:
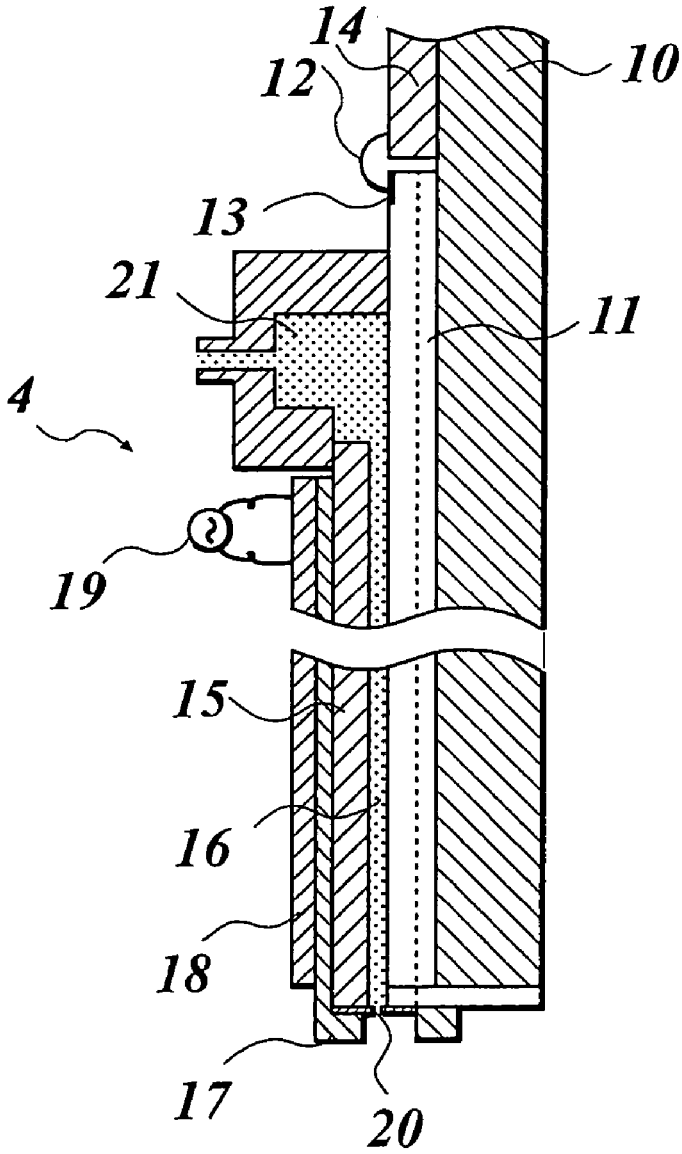
FIG. 2 is a view showing a structure of a recording head of the ink jet printer of the invention.

The recording head 4, as shown in FIG. 2, has a substrate 10. A piezoelectric element 11 is disposed at one end of the substrate 10. A piezoelectric element driving circuit 14 is connected to the piezoelectric element 11 through a lead wire 12 and an electrode 13. A passage plate 15 is disposed opposite to the piezoelectric element 11. An ink passage 16 is formed by the piezoelectric element 11 and the passage plate 15. When the pulsed signal voltage is applied to the piezoelectric element 11 by the piezoelectric element driving circuit 14, the piezoelectric element 11 is expanded. This causes constriction of the ink passage 16. A heater 18 is disposed on the upper surface of the passage plate 15 via a thermal member 17. A heater power source 19 is connected to the heater 18. One end of the ink passage 16 is communicated with the nozzles 20. The other end thereof is communicated with a common fluid reservoir 21 for a plurality of the ink passages 16.

Figure 3:
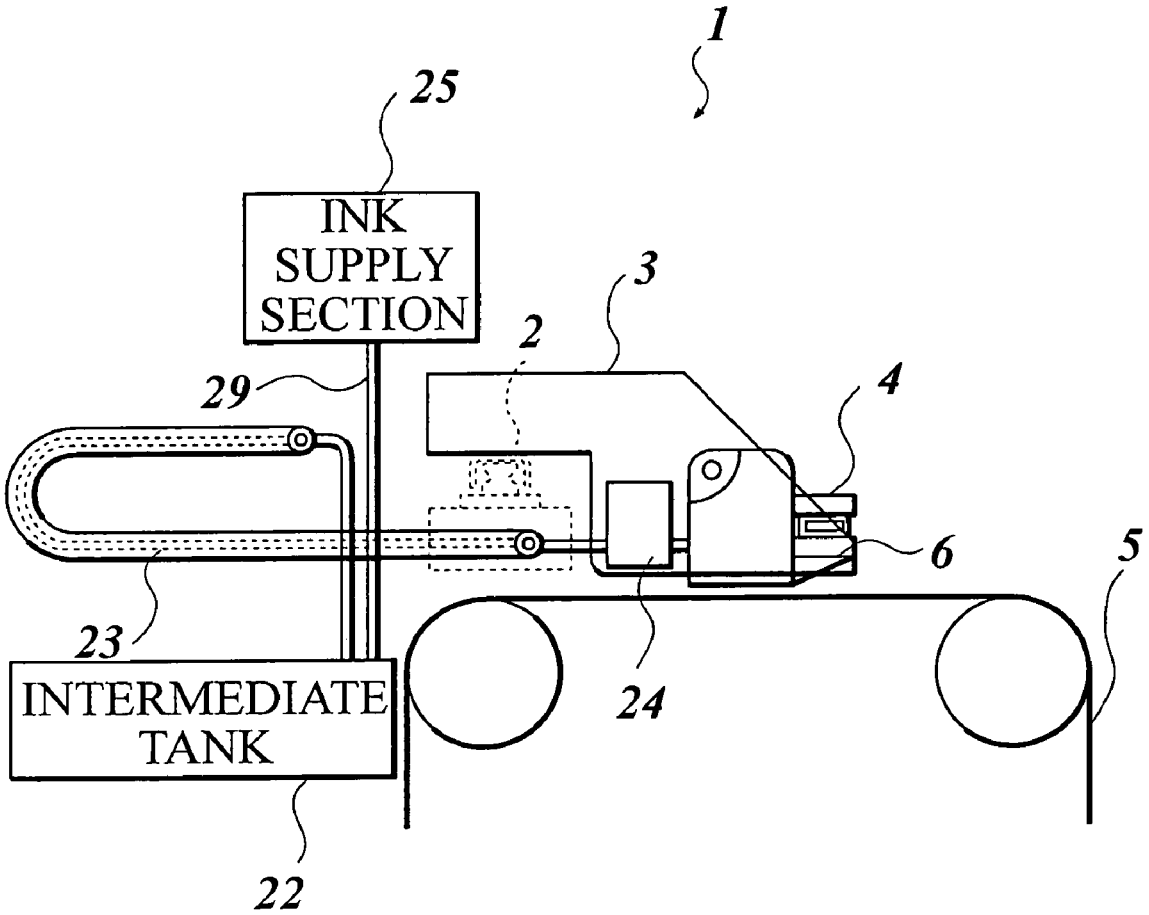
FIG. 3 is a view showing a structure of one of the embodiments of the ink jet printer of the invention.

As shown in FIG. 3, in the backside of the carriage 3, an intermediate tank 22 for temporarily storing ink is disposed in a lower position of the recording head 4. The intermediate tank 22 is communicated with the fluid reservoir 21 through an ink supply line 23 and a damper 24.

Further, in the backside of the carriage 3, an ink supply section 25 for supplying the intermediate tank 22 with ink, is disposed in an upper position of the recording head 4. The ink supply section 25 and the intermediate tank 22 are communicated with each other through an ink supply line 29.

Here, when the viscosity of the ink to be used is $\mu$, a length L and a diameter d of the ink supply line 23 are satisfy an inequality:

$$(1.411\times10^{9}\times d^{4})/L>\mu. \quad (1)$$

Because the length of the ink supply line 23 is susceptible to mechanical constraint such as moving distance of the carriage 3 and the distance between the ink supply section 25 and the intermediate tank 22, it is preferable that the diameter of the ink supply line 23 is adjusted to satisfy the formula 1.

For example, in view of mechanical constraint of the ink jet printer 1, it is required that the length of the ink supply line 23 be 2 m. It is required that the diameter of the ink supply line 23 be more than or equal to 2.55 mm when the viscosity of the ink to be used is 0.03 Pa·s.

The formula (1) is hereinafter described. When a general formula of pressure loss is applied to ink and the ink supply line, pressure loss $h_0$ satisfies an equality:

$$h_0=128\times L\times P\times ch\times A\times\mu/(\pi\times d^{4}\times g\times\rho). \quad (2)$$

Note,

P: the drop amount of ink ($m^3$)

ch: the number of nozzles

A: frequency of the pulsed signal voltage g: gravitational acceleration

ρ: ink density

When pressure loss $h_0$ in the ink supply line 23 increases, ink is not fully supplied and abnormal jetting of ink is caused. Thereby, image concentration lacks in uniformity. Therefore, pressure loss $h_0$ should be restrained lower than the predetermined value h in relation to the ink viscosity $\mu$ and the drop amount of ink jetted from the nozzles. This satisfies an inequality:

$$h>128\times L\times P\times ch\times A\times\mu/(\pi\times d^{4}\times g\times\rho). \quad (3)$$

P×ch×A indicates the amount of ink jetted per second from the recording head 4. Even when the amount of ink jetted per second from the recording head 4 is the largest, it is needed that pressure loss $h_0$ is less than the predetermined value h.

Here, the case that high viscosity ink is used and the amount of ink jetted per second is the largest will be considered. To obtain a high-definition image, for example, it is preferable that one dot is formed by shooting seven small ink drops in which the drop amount of each drop is 4 pl. In this case, the drop amount of ink per dot is required 28 pl or $2.8\times10^{-14}$ $m^3$. Further, when the number of nozzles 20 formed on the recording head 4 is 768 and the frequency of the pulsed signal voltage to be applied to jet ink from each nozzle 20 is 4 kHz, the amount of ink jetted per second from the recording head 4 is $86.0\times10^{-9}$ $m^3$. Further, for example, when two ink drops in which the drop amount of each drop has 40 pl can be-shot per pixel and the number of nozzles 20 formed on the recording head 4 is 768 and the frequency of the pulsed signal voltage to be applied to jet ink from each nozzle 20 is 14 kHz, the amount of ink jetted per second from the recording head 4 is $86.0\times10^{-9}$ $m^3$.

When ink density is 1010, the above terms are substituted for the formula (3) to satisfy an equality:

$$(2.823\times10^{9}\times d^{4})/L>\mu/h. \quad (4)$$

Here, on the assumption that ink having viscosity $\mu$ of 80 mPa·S is applied, small ink drop cannot be jetted when pressure loss h is more than or equal to 0.5. For that, when the relation between viscosity $\mu$ and the length L and the diameter d of the ink supply line 23 is formularized in case of h=0.5 ($mH_2O$), the above formula (1) can be obtained.

Figure 4:
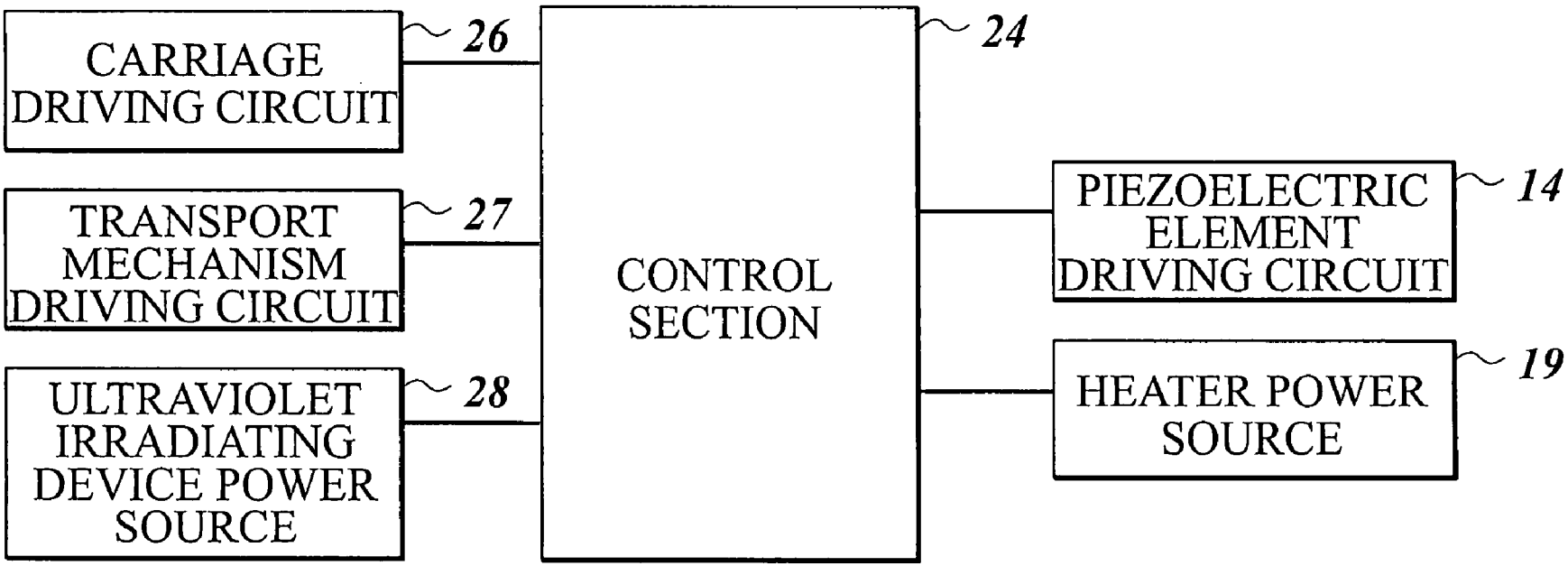
FIG. 4 is a block diagram showing a structure of one of the embodiments of the ink jet printer of the invention.

Further, the ink jet printer 1, as shown in FIG. 4, comprises the piezoelectric element driving circuit 14, the heater power source 19, a carriage driving circuit 26, the transport mechanism driving circuit 27 and a control section 29 for controlling an ultraviolet irradiating device power source 28.

Further, the control section 29 controls the piezoelectric element driving circuit 14 to apply voltage to the predetermined piezoelectric element 11 on the basis of the predetermined image signal.

Further, the control section 29 controls the temperature of the heater 18 by turning on or turning off the heater power source 19. In addition, in view of jetting stability of ink, it is preferable that the recording head 4 and ink are heated by the heater 18 between 30° C. and 150° C. when ink is jetted. Further, ultraviolet curable ink has a wide viscosity range resulted from temperature fluctuation. Because viscosity fluctuation directly affects droplet size and droplet injection rate, it is required that the heater power source 19 be controlled to keep ink temperature constant while temperature is increased.

Further, the control of the piezoelectric element driving circuit 14 and the heater power source 19, in view of ink character, is conducted so that the drop amount of ink for each dot jetted from the nozzles 20 is between 2 pl and 20 pl.

Further, the control section 29 controls the carriage driving circuit 26. The carriage driving circuit 26 moves a driving mechanism of the carriage 3 on the basis of a signal from the control section 29 to reciprocate the carriage 3 in the main scanning direction X.

Further, the control section 29 controls the transport mechanism driving circuit 27. The transport mechanism driving circuit 27 moves the transport mechanism on the basis of a signal from the control section 29 to transport the recording medium 5 in the sub scanning direction Y.

Further, the control section 29 controls the emission of an ultraviolet light source by turning on or turning off the ultraviolet irradiating device power source 28.

Further, as the recording medium 5, it is applicable for standard paper, recycle paper, gloss paper or the like, and the recording medium 5 consisting of fabric or the like, non-woven fabric or the like, plastic, metal, glass and the like. In particular, as the recording medium 5 used in the embodiment, it is applicable for a non-absorbable resin film. The non-absorbable resin film that is transparent or opaque is often used for a flexible package. As a form of the recording medium 5, it is applicable for roll-shaped, cut-sheet, and plate-shaped media.

The function of the embodiment will be described below.

The piezoelectric element driving circuit 14 is controlled by the controlling section 29 on the basis of the predetermined image signal, and voltage is applied through the lead wire 12 and the electrode 13 to the selected predetermined piezoelectric element 11. When voltage is applied to the piezoelectric element 11, the piezoelectric element 11 is expanded upward, and then the ink passage 16 is constricted and ink is jetted from the nozzles 20. At this time, because the heater power source 19 is controlled by the control section 29, ink is heated to the predetermined temperature by the heater 18 via a thermal member 17 and the passage plate 15. Thereby, the drop amount of ink for each dot that is between 2 pl and 20 pl is jetted from the nozzles 20.

At this time, because pressure loss of the ink supply line 23 is less than or equal to 0.5, the amount of ink that is the same amount of ink jetted from the recording head 4 is supplied from the intermediate tank 22 through the ink supply line 23 to the recording head 4. As a result, the proper amount of ink is always supplied from the ink supply section 25 to the recording head 4.

Further, when ink is jetted from the recording head 4, because the carriage driving circuit 26 is controlled by the control section 29, the driving mechanism of the carriage 3 is activated, and then the carriage 3 is reciprocating in the main scanning direction X in an upper position of the recording medium 5. The jetted ink spots onto the recording medium 5 by turns. Meanwhile, because the power source of the ultraviolet irradiating device 6 disposed in the carriage 3 is controlled by the control section 29, the ultraviolet irradiating device 6 are irradiating ultraviolet rays while reciprocating in the main scanning direction X in an upper position of the recording medium 5. Thereby, ultraviolet rays are irradiated to the spotted ink on the recording medium 5, and then ink is cured.

Further, because the transport mechanism driving circuit 27 is controlled by the control section 29, the transport mechanism is activated, and then the recording medium 5 is transported in the sub scanning direction Y. An image is recorded onto the recording medium 5.

Hence, according to the embodiment of the present invention, because the length L and the diameter d of the ink supply line 23 are designed by the formula (1), even if the pressure supply system is not provided, the proper amount of ink is always supplied to the recording head 4. As a result, even if ink is continuously jetted from all of the nozzles 20, a good image can be recorded by a simple design without abnormal jetting of ink.

Further, in the embodiment, although ink that is cured by ultraviolet irradiation is used, the present invention is not limited to this. In addition to ultraviolet rays, the other light for curing ink by irradiation may be used. Here, "light" broadly includes ultraviolet rays, electron rays, X rays, visible rays and infrared rays. In other words, as ink, polymerized compound that is polymerizable and curable for other light out of ultraviolet rays, and photoinitiator that initiates polymerization reaction among polymerized compound by other light out of ultraviolet rays, may be applied. In case photo-curing ink that is cured by other light out of ultraviolet rays is used, light source irradiating light for irradiating the light is applied in place of ultraviolet light source. Further, ink that is cured without light irradiation may be applied.

Second Embodiment:

Another embodiment of the present invention is hereinafter described with reference to FIG. 5. Further, an ink jet printer 30 of the embodiment has the same structure as the first embodiment, except a diameter and a length of an ink supply line 31. Especially, the features that are different from those of the first embodiment will be hereinafter described.

Figure 5:
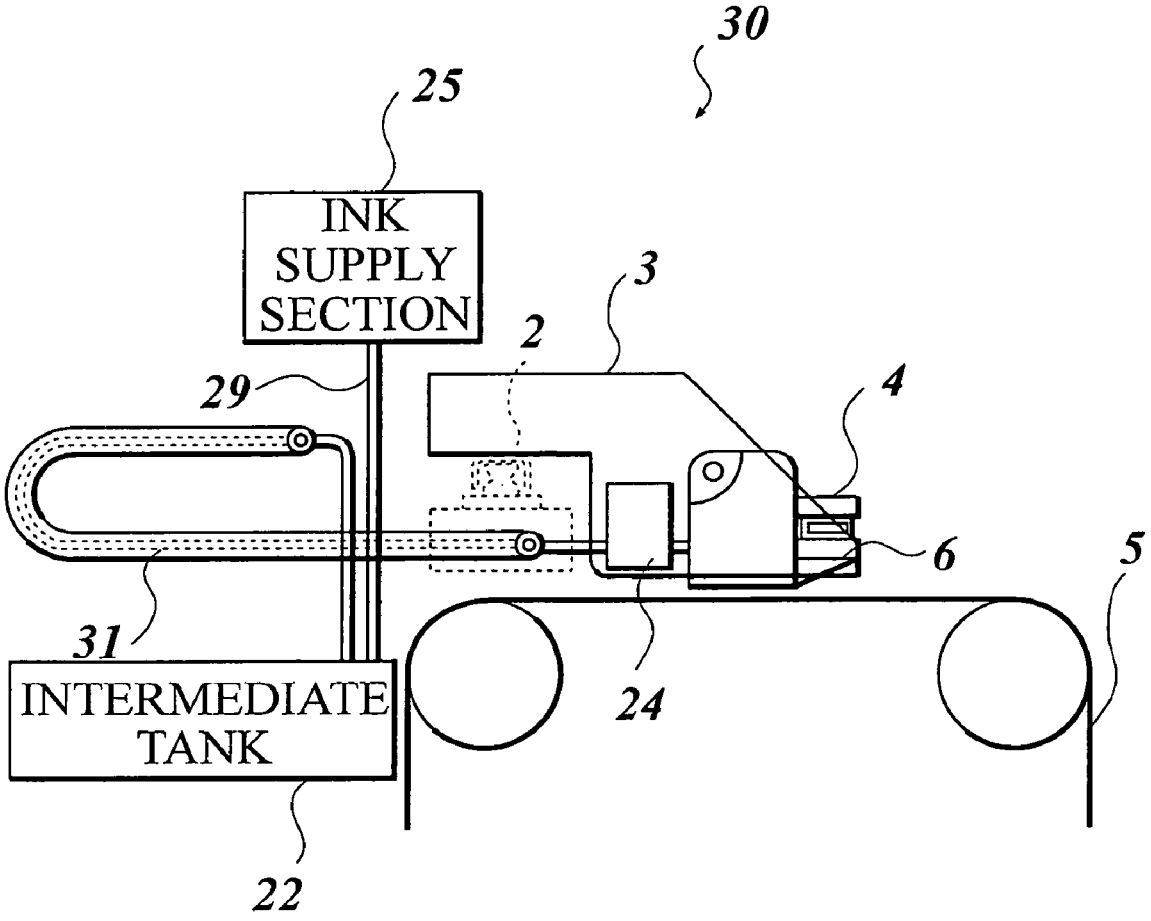
FIG. 5 is a view showing a structure of one of the embodiments of the ink jet printer of the invention.

The ink jet printer 30 of the embodiment, as shown in FIG. 5, is a serial-head type of ink jet printer 30. The carriage 3 is supported by the driving mechanism (not illustrated) to reciprocate along the guide rail 2 in the main scanning direction X. The carriage 3 comprises a recording head 4. The ultraviolet irradiating device 6 for irradiating ultraviolet rays are disposed at the both ends of the carriage 3 along the main scanning direction X.

Further, in the backside of the carriage 3, the intermediate tank 22 for supplying ink through the ink supply line 31 and the damper 24 to the recording head 4 is disposed in a lower position of the recording head 4. Further, in the backside of the carriage 3, the ink supply section 25 for supplying ink to the intermediate tank 22 through the ink supply line 29 is disposed in an upper position of the recording head 4.

Here, when the flow velocity V of the ink is one at which a predetermined amount of ink having a predetermined viscosity is jetted per second from the recording head, a flow velocity of the ink to be used is V, the length L and the diameter d of the ink supply line 31 are set so as to satisfy an inequality:

$$(2500\times d^2)/L>V. \tag{5}$$

Further, because the length of the ink supply line 31 is susceptible to mechanical constraint such as moving distance of the carriage 3, it is preferable that the diameter of the ink supply line 31 is adjusted to satisfy the formula (5).

For example, in view of mechanical constraint of the ink jet printer 30, it is required that the length of the ink supply line 31 be 1 m. It is required that the diameter of the ink supply line 31 be more than or equal to 3.3 mm when the velocity of ink is 0.0027 m/s.

The formula (5) is hereinafter described. In the general formula of pressure loss, when friction coefficient $\lambda$ is 4/Re and Re is $(\rho\times V\times d)/\mu$, the pressure loss $h_0$ is:

$$h_0=(32\times\mu\times L\times V)/(\rho\times d^2\times g). \tag{6}$$

Note, $\mu$: ink viscosity g: gravitational acceleration $\rho$: ink density

When pressure loss $h_0$ in the ink supply line 31 increases, ink is not fully supplied and abnormal jetting of ink is caused. Thereby, image concentration lacks in uniformity. Therefore, pressure loss $h_0$ should be restrained lower than the predetermined value h in relation to the ink viscosity $\mu$. This satisfies an inequality:

$$h>(32\times\mu\times L\times V)/(\rho\times d^2\times g). \tag{7}$$

Here, in case that ink having the average viscosity $\mu$ of 30 mPa·S is applied, ink cannot be jetted when pressure loss h is more than or equal to 0.25. For that, when the relation between velocity V of ink and the length L and the diameter d of the ink supply line 23 is formularized by the formula (7) in case of h=0.25 ($mH_2O$) and $\rho$ (ink density)=1010, the above formula (5) can be obtained.

The function of the embodiment will be described below.

When image is recorded on the recording medium 5, the driving mechanism of the carriage 3 is activated. Further, while the carriage 3 is reciprocated in the main scanning direction X in an upper position of the recording medium 5, the predetermined color ink is jetted from the recording head 4 on the basis of the predetermined image information.

At this time, because pressure loss of the ink supply line 31 is less than or equal to 0.25, when the predetermined amount of ink is jetted from the recording head 4, ink is supplied at a velocity V from the ink supply section 25 through the ink supply line 31 and the intermediate tank 22 to the recording head 4. Therefore, because the proper amount of ink is always supplied from the ink supply section 25 to the recording head 4, ink is always stably jetted from the recording head 4.

Ink jetted from the recording head 4 spots onto the recording medium 5 by turns. Further, ultraviolet rays are irradiated by turns to the spotted ink on the recording medium 5 by the ultraviolet irradiating device 6 reciprocating with the carriage 3. Thereby, ink is cured on the recording medium 5 and then an image is recorded on the recording medium.

The entire disclosure of Japanese Patent Application No. Tokugan 2003-411566 filed on Dec. 10, 2003, Japanese Patent Application No. Tokugan 2003-18721 filed on Jan. 28, 2003 and Japanese Patent Application No. Tokugan 2003-18728 filed on Jan. 28, 2003 including specification, claims, drawings and summary are incorporated herein by reference in its entirety.

What is claimed is:

1. An ink jet printer comprising:

a recording head having nozzles for jetting ink onto a recording medium;

an intermediate tank for temporarily storing ink in a lower position of the recording head; and an ink supply line for feeding the ink between the intermediate tank and the recording head;

wherein when a viscosity of the ink is $\mu$ and pressure loss which allows the ink to be stably jetted is h, a length L and a diameter d of the ink supply line satisfy an inequality: $(2.823\times10^9\times d^4)/L>\mu/h$.

2. The ink jet printer of claim 1, wherein the ink has the viscosity of not less than 10 mPa·s and not more than 500 mPa·s at a temperature of 30° C.; the recording head comprises a heater for heating ink and a control section for controlling a temperature of the heater; and the control section controls the heater to heat the ink to a temperature of not less than 30° C. and not more than 150° C.

3. The ink jet printer of claim 1, wherein the ink is ultraviolet curable ink, and the ink jet printer further comprises an ultraviolet irradiating device for irradiating ultraviolet rays for curing the ultraviolet curable ink.

4. The ink jet printer of claim 3, wherein the ultraviolet curable ink is cationic polymerized ink.

5. The ink jet printer of claim 3, wherein the recording medium is made of material that does not absorb ink.

6. An ink jet printer comprising:

a recording head having nozzles for jetting ink onto a recording medium;

an intermediate tank for temporarily storing ink in a lower position of the recording head; and an ink supply line for feeding the ink between the intermediate tank and the recording head;

wherein when a viscosity of the ink is $\mu$, a length L and a diameter d of the ink supply line satisfy an inequality: $(1.411\times10^9\times d^4)/L>\mu$.

7. The ink jet printer of claim 6, wherein a viscosity of the ink is not less than 10 mPa·s and not more than 500 mPa·s at a temperature of 30° C., and the recording head comprises a heater for heating ink and a control section for controlling a temperature of the heater and the control section controls the heater to heat the ink to a temperature of not less than 30° C. and not more than 150° C.

8. The ink jet printer of claim 6, wherein the ink is ultraviolet curable ink and an ultraviolet irradiating device for irradiating ultraviolet rays for curing the ultraviolet curable ink is disposed.

9. The ink jet printer of claim 8, wherein the ultraviolet curable ink is cationic polymerized ink.

10. The ink jet printer of claim 8, wherein the recording medium is made of material that does not absorb ink.

11. An ink jet printer comprising:

a recording head having nozzles for jetting ink onto a recording medium;

an intermediate tank for temporarily storing ink in a lower position of the recording head; and an ink supply line for feeding the ink between the intermediate tank and the recording head;

wherein when a predetermined amount of ink having a predetermined viscosity is jetted from the recording head, a flow velocity of ink in the ink supply line is V, a length L and a diameter d of the ink supply line satisfy an inequality: $(2500\times d^2)/L>V$.

12. The ink jet printer of claim 11, wherein the recording head comprises a heater for heating ink and a control section for controlling a temperature of the heater and the control section controls the heater to heat the ink to a temperature of not less than 30° C. and not more than 150° C.

13. The ink jet printer of claim 11, wherein the ink is ultraviolet curable ink and an ultraviolet irradiating devices for irradiating ultraviolet rays for curing the ultraviolet curable ink is disposed.

14. The ink jet printer of claim 13, wherein the ultraviolet curable ink is cationic polymerized ink.

15. The ink jet printer of claim 13, wherein the recording medium is made of material that does not absorb ink.

* * * * *

UNITED STATES PATENT AND TRADEMARK OFFICE

CERTIFICATE OF CORRECTION

PATENT NO. : 7,014,285 B2
APPLICATION NO. : 10/761630
DATED : March 21, 2006
INVENTOR(S) : Ryuji Tanno It is certified that error appears in the above-identified patent and that said Letters Patent is hereby corrected as shown below:

Title Page:
(73) Assignee, delete "Konien" and insert therefor -- Konica --

Column 6:
Line 7, after "can" delete "be-shot" and insert therefor -- be shot --

Signed and Sealed this

Fifteenth Day of August, 2006

JON W. DUDAS
*Director of the United States Patent and Trademark Office*